US011284772B2

(12) United States Patent
Calvimontes et al.

(10) Patent No.: US 11,284,772 B2
(45) Date of Patent: Mar. 29, 2022

(54) METHOD FOR OPERATING A DISH WASHING MACHINE AND DISH WASHING MACHINE

(71) Applicant: BSH Hausgeräte GmbH, Munich (DE)

(72) Inventors: Alfredo Calvimontes, Dillingen a. d. Donau (DE); Kai Paintner, Welden (DE)

(73) Assignee: BSH Hausgeräte GmbH, Munich (DE)

( * ) Notice: Subject to any disclaimer, the term of this patent is extended or adjusted under 35 U.S.C. 154(b) by 716 days.

(21) Appl. No.: 15/761,434

(22) PCT Filed: Oct. 20, 2016

(86) PCT No.: PCT/EP2016/075262

§ 371 (c)(1),
(2) Date: Mar. 20, 2018

(87) PCT Pub. No.: WO2017/084827

PCT Pub. Date: May 26, 2017

(65) Prior Publication Data

US 2019/0045998 A1 Feb. 14, 2019

(30) Foreign Application Priority Data

Nov. 16, 2015 (DE) ..... 102015222586.0

(51) Int. Cl.
*A47L 15/42* (2006.01)
*A47L 15/00* (2006.01)

(52) U.S. Cl.
CPC ..... *A47L 15/0057* (2013.01); *A47L 15/4276* (2013.01); *A47L 2401/34* (2013.01);
(Continued)

(58) Field of Classification Search
CPC .. A47L 15/4276; A47L 15/0057; A47L 15/46; A47L 15/4236; A47L 15/4295;
(Continued)

(56) References Cited

U.S. PATENT DOCUMENTS 7,610,779 B2 * 11/2009 Yang ..... D06F 31/005 68/12.02
7,708,837 B2 5/2010 Kuran et al.
(Continued)

FOREIGN PATENT DOCUMENTS

CN 101803896 A 8/2010
EP 0509328 A2 10/1992
(Continued)

OTHER PUBLICATIONS

International Search Report PCT/EP2016/075262 dated Dec. 14, 2016.
(Continued)

*Primary Examiner* — Michael E Barr
*Assistant Examiner* — Thomas Bucci
(74) *Attorney, Agent, or Firm* — Michael E. Tschupp; Andre Pallapies; Brandon G. Braun

(57) ABSTRACT

In a method for operating a dishwasher, in particular a domestic dishwasher, items to be washed arranged in an interior of the dishwasher are washed during a wash program. A quantity of a specific gas in the interior is determined during the wash program, and a hygiene program is started and/or a notification is outputted to a user of the dishwasher relating to a start of the hygiene program as a function of the determined quantity of the specific gas.

5 Claims, 4 Drawing Sheets

(52) U.S. Cl.
CPC ..... *A47L 2501/16* (2013.01); *A47L 2501/26* (2013.01); *A47L 2501/34* (2013.01)

(58) Field of Classification Search
CPC ..... A47L 2401/34; A47L 2401/30; A47L 2401/04; A47L 2501/26; A47L 2501/16; A47L 2501/34; A47L 2501/30
See application file for complete search history.

(56) References Cited

U.S. PATENT DOCUMENTS

| | | | | |
|---|---|---|---|---|
| 8,377,223 | B2 | 2/2013 | Classen | |
| 9,131,827 | B2 * | 9/2015 | Usta Yogun | A47L 15/4276 |
| 2004/0005715 | A1 * | 1/2004 | Schabron | G01N 27/70 436/104 |
| 2004/0223882 | A1 * | 11/2004 | Bonne | G01N 1/24 422/82.05 |
| 2005/0142035 | A1 * | 6/2005 | Bonne | B82Y 10/00 422/82.05 |
| 2005/0262883 | A1 * | 12/2005 | Yang | D06F 58/203 68/12.01 |
| 2006/0096618 | A1 * | 5/2006 | Price | D06F 35/003 134/25.2 |
| 2008/0008625 | A1 * | 1/2008 | Thomas | G01N 21/3504 422/82.05 |
| 2008/0092931 | A1 * | 4/2008 | Karaaslan | A47L 15/46 134/57 D |
| 2009/0053989 | A1 * | 2/2009 | Lunde | A61L 9/00 454/187 |
| 2009/0084157 | A1 * | 4/2009 | Krogh | G01N 33/1826 73/23.4 |
| 2010/0282280 | A1 * | 11/2010 | Usta Yogun | A47L 15/4295 134/56 D |
| 2010/0300487 | A1 * | 12/2010 | Rolek | A47L 15/0005 134/10 |
| 2012/0055513 | A1 * | 3/2012 | Eglmeier | A47L 15/42 134/22.1 |
| 2013/0152969 | A1 * | 6/2013 | Seong | A47L 15/4291 134/18 |
| 2013/0167618 | A1 * | 7/2013 | Grosse Bley | D06F 39/081 73/40 |

FOREIGN PATENT DOCUMENTS

| | | | |
|---|---|---|---|
| EP | 2397062 | A2 | 12/2011 |
| EP | 2762052 | A1 | 8/2014 |
| EP | 2762053 | A1 | 8/2014 |
| JP | 2007209437 | A | 8/2007 |
| JP | 2008307164 | A | 12/2008 |
| KR | 20110102651 | A | 9/2011 |

OTHER PUBLICATIONS

National Search Report DE 10 2015 222 586.0 dated Aug. 11, 2016.
National Search Report CN 201680066749.3 dated May 6, 2020.

* cited by examiner

METHOD FOR OPERATING A DISH WASHING MACHINE AND DISH WASHING MACHINE

CROSS-REFERENCES TO RELATED APPLICATIONS

This application is the U.S. National Stage of International Application No. PCT/EP2016/075262, filed Oct. 20, 2016, which designated the United States and has been published as International Publication No. WO 2017/084827 A1 and which claims the priority of German Patent Application, Serial No. 10 2015 222 586.0, filed Nov. 16, 2015, pursuant to 35 U.S.C. 119(a)-(d).

BACKGROUND OF THE INVENTION

The present invention relates to a method for operating a dishwasher, wherein items to be washed that are arranged in an interior of the dishwasher are washed during a wash program. The present invention also relates to such a dishwasher.

To control the performance of wash programs the dishwasher comprises a control apparatus or control device. The control apparatus is designed to select a specific wash program from a plurality of prespecified wash programs, for example rapid wash program, glass cleaning program, program for cleaning heavily encrusted items, automatic program, etc., as a function of an input by a user of the dishwasher. In particular the control apparatus here also ensures that the individual program segments of the respectively selected wash program, for example pre-rinse, clean, rinse, final rinse or dry, are performed in the correct sequence and in compliance with the desired operating parameters, such as temperature of wash liquor, pause times, in which there is no wash liquor circulation or discharge, dispensing of detergent, etc.

However bacteria can grow in an unwanted manner within the dishwasher, resulting ultimately in an odor problem or even danger to the health of the user of the dishwasher, in particular if the dishwasher remains in the loaded state, in other words partially or completely filled with soiled items to be washed, for quite long periods, without a wash program being performed.

Conventional dishwashers are known from the documents WO 2006/082552 A, JP 2008307 164 A, WO 2009/083391 A, EP 2 762 052 A1, EP 2 762 053 A1 and DE 10 2005 058 662 A1.

BRIEF SUMMARY OF THE INVENTION

Against this background one object of the present invention is to improve the operation of a dishwasher.

A method for operating a dishwasher is therefore proposed, wherein items to be washed that are arranged in an interior of the dishwasher are washed during a wash program. The method comprises the steps: determining a quantity of at least one specific gas in the interior during a wash program and starting a hygiene program and/or outputting a notification to a user of the dishwasher relating to the start of the hygiene program as a function of the determined quantity of the at least one specific gas. The dishwasher is in particular a domestic dishwasher.

Determining the gas or gases during the wash program allows the hygiene program to be started during the wash program or immediately after the end of the wash program. This minimizes bacterial contamination of the interior of the dishwasher and any resulting odor problem for the user of the dishwasher. It is thus possible to raise the hygiene standard.

It is possible to determine the type of soiling and/or the degree of soiling of the soiling in the interior of the dishwasher as a function of the determined quantity of the specific gas or gases in the interior of the dishwasher. It is then also possible, as a function of the determined type of soiling and/or the determined degree of soiling, to select a suitable hygiene program from a plurality of preset hygiene programs and to execute it. This further maximizes the hygiene standard. The deployment of the hygiene program during the wash program or immediately after the end of the wash program also produces a better cleaning result for the items being washed as well as saving energy. Examples of specific gases are methane, ethylene and butane.

In particular a wash program comprises one or more of the following phases: pre-rinse, cleaning cycle, intermediate rinse, final rinse and/or drying cycle. The phases can be configured differently in different wash programs.

According to one embodiment the method comprises adjusting the wash program as a function of the determined quantity of the at least one specific gas, if the determined quantity is greater than a specific threshold value.

During the adjustment of the wash program operating parameters of the wash program, such as temperature of the wash liquor, pause times, dispensing of detergent, etc., in particular are adjusted. It is also possible to construct a new wash program, in particular in respect of detergent composition, a temperature profile or the dispensing of bleaching agents, as a function of the determined quantity of the at least one specific gas. The specific threshold value can be set by a user in particular by means of an input apparatus.

For example mashed potato residues can be identified as soiling. The concentration of such residues can then be evaluated and the enzyme amylase can be applied as a function thereof, in order to set the optimum operating parameters, in particular in respect of pH value, concentration and temperature, in order to allow optimum cleaning.

Milk residues and their concentration can also be identified. The enzyme protease can be applied as a function of the concentration of the milk residues, in order to allow optimum cleaning by way of regulated operating parameters.

A concentration of tea can also be identified. A bleaching agent, for example sodium percarbonate or tetraacetylethylenediamine, can be applied as a function of the identified concentration of tea, in order to set optimized operating parameters to allow optimum bleaching.

According to a further embodiment the method comprises determining a respective quantity of a plurality of different specific gases in the interior by means of a plurality of different gas sensors during the wash program.

A respective gas sensor can in particular detect a specific gas. For example there are specific gas sensors for methane or butane.

According to a further embodiment the method comprises:

taking a specimen of a gas mixture present in the interior during the wash program, supplying the specimen of the gas mixture taken to a gas sensor container holding a plurality of different gas sensors, and determining a respective quantity of a plurality of different specific gases by means of the gas sensors in the gas sensor container during the wash program.

For example the gas mixture specimen is taken from the interior or wash container of the dishwasher by means of warm or hot air. The warm or hot air is generated for example by means of a heater and blower. The gas mixture specimen can then be added to a concentration container upstream of the gas sensor container holding the plurality of gas sensors.

According to a further embodiment the specimen of the gas mixture present in the interior is taken using warm air during the wash program.

According to a further embodiment the method comprises determining a spectrum by means of the determined quantities of the plurality of different specific gases.

According to a further embodiment the method comprises starting the hygiene program and/or outputting the notification to the user of the dishwasher relating to the start of the hygiene program as a function of the determined spectrum.

According to a further embodiment VOC sensors are used as the gas sensors. A VOC sensor is a volatile organic compound sensor.

According to a further embodiment the spectrum is determined by means of pattern recognition using a neural network and a reference database.

Pattern recognition can be performed for example by the control apparatus of the dishwasher, which implements the neural network using the determined spectrum and the reference data from the reference database.

According to a further embodiment determining the quantity of the specific gas in the interior during the wash program comprises determining the absolute quantity of the specific gas in the interior.

According to a further embodiment determining the quantity of the specific gas in the interior during the wash program comprises determining a change in the absolute quantity of the specific gas in the interior over time.

According to a further embodiment determining the quantity of the specific gas in the interior during the wash program comprises determining a concentration of the specific gas in the interior.

A computer program product is also proposed, which initiates the performance of the method as described above on a program-controlled facility.

A computer program product, for example a computer program means, can be provided or supplied for example as a storage medium, for example a memory card, USB stick, CD-ROM, DVD or even in the form of a downloadable file from a server in a network. This can be done for example by transferring a corresponding file containing the computer program product or the computer program means in a wireless communication network.

A dishwasher, in particular a domestic dishwasher, is also proposed, having an interior for holding items to be washed and a control apparatus for performing a number of wash programs to wash the items to be washed. The dishwasher comprises a gas sensor for determining a quantity of at least one specific gas in the interior during the wash program, a start unit for starting a hygiene program as a function of the determined quantity of the at least one specific gas and/or an output unit for outputting a notification to a user of the dishwasher relating to the start of the hygiene program as a function of the determined quantity of the at least one specific gas.

According to one embodiment the dishwasher comprises a plurality of different gas sensors for determining a plurality of different specific gases in the interior.

According to a further embodiment the dishwasher comprises a spectrometer for determining a spectrum by means of the determined quantities of the plurality of different specific gases.

According to a further embodiment the start unit is integrated in the control apparatus.

According to a further embodiment the output unit is integrated in the control apparatus.

The respective unit, for example start unit or output unit, can be implemented by means of hardware and/or software. When implemented by means of hardware, the respective unit can be configured as an apparatus or part of an apparatus, for example as a computer or microprocessor or as a control computer of a vehicle. When implemented by means of software, the respective unit can be configured as a computer program product, a function, a routine, part of a program code or an executable object.

The embodiments and features described for the proposed method apply correspondingly to the proposed apparatus.

Further possible implementations of the invention also include combinations of features or embodiments described above or in the following in respect of the exemplary embodiments, even if these are not cited specifically. The person skilled in the art will also add individual aspects to improve or supplement the respective basic form of the invention.

BRIEF DESCRIPTION OF THE DRAWINGS

Further advantageous configurations and aspects of the invention are set out in the subclaims and the exemplary embodiments of the invention described in the following. The invention is described in more detail below based on preferred embodiments with reference to the accompanying figures, in which:

DETAILED DESCRIPTION OF EXEMPLARY EMBODIMENTS OF THE PRESENT INVENTION

Figure 1:
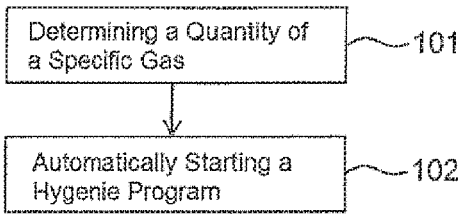
FIG. 1 shows a first exemplary embodiment of a method for operating a dishwasher.

Identical elements or those of identical function are shown with the same reference characters in the figures, unless otherwise specified.

FIG. 1 shows a first exemplary embodiment of a method for operating a dishwasher 1.

Figure 5:
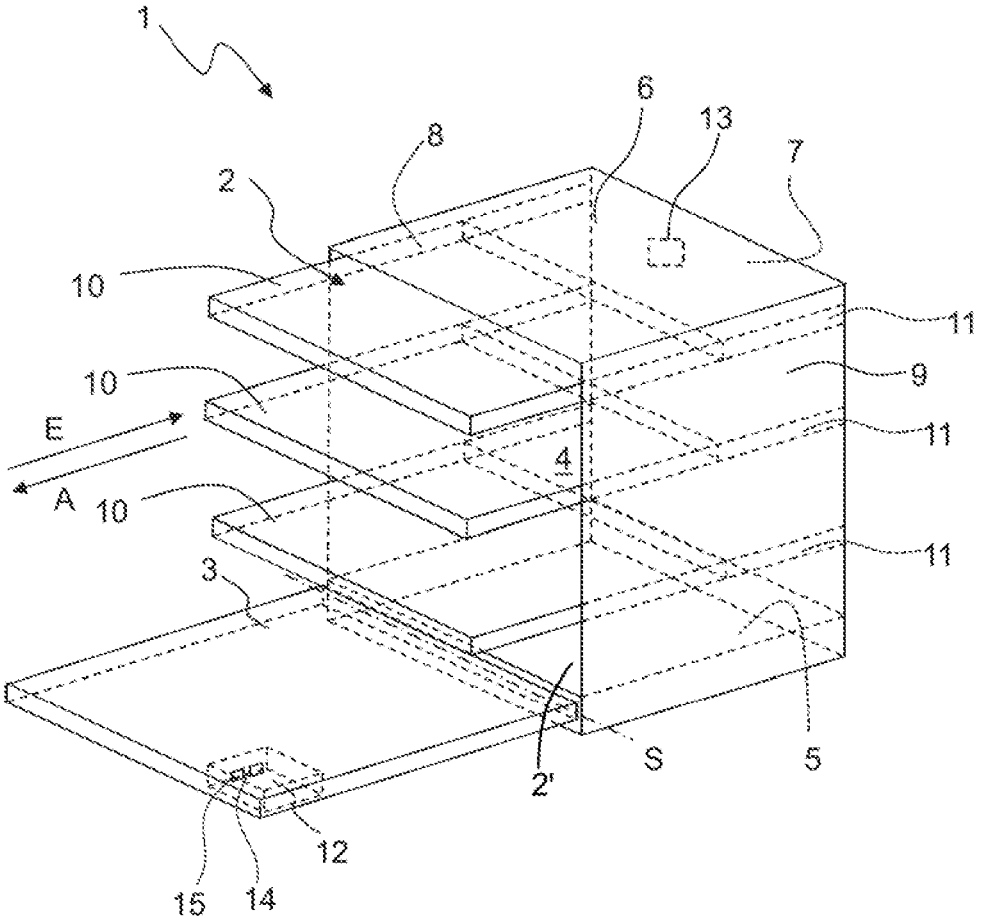
FIG. 5 shows a perspective view of an embodiment of a dishwasher.
Figure 6:
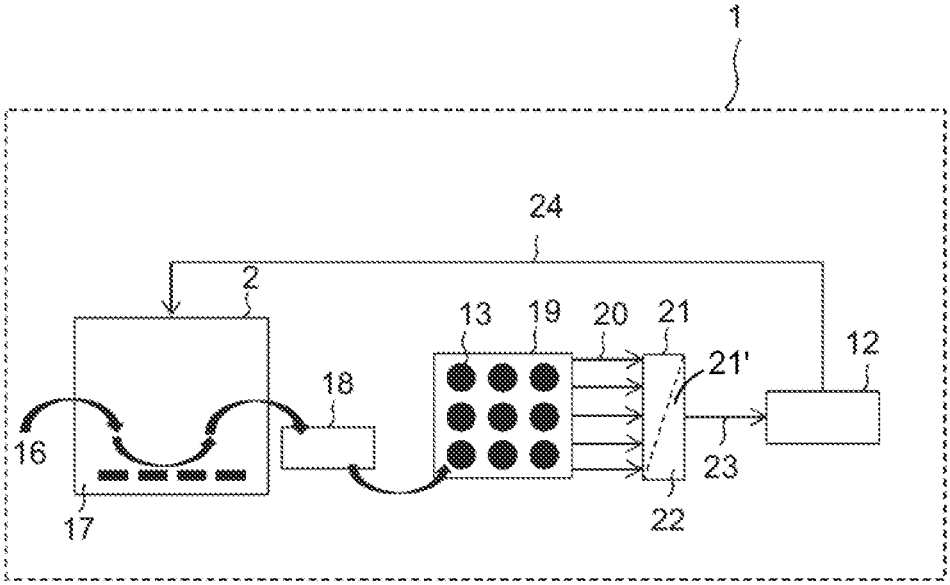
FIG. 6 shows a schematic block diagram of a further embodiment of a dishwasher.

The dishwasher 1 is in particular a domestic dishwasher. The dishwasher 1 has an interior 2. The interior 2 comprises in particular a wash container 2'. The interior 2 is designed to hold items to be washed. The dishwasher 1 also comprises a control apparatus or controller 12, which is designed to control the performance of a number of wash programs to wash the items to be washed in the wash container 2'. Examples of a dishwasher 1 are illustrated in FIGS. 5 and 6 and are described in more detail in the following.

The first exemplary embodiment of the method according to FIG. 1 comprises the steps 101 and 102:

In step 101 a quantity of at least one specific gas in the interior 2 or wash container of the dishwasher 1 is determined during the performance of the wash program. Determining 101 the quantity of the specific gas in the interior 2 during the wash program comprises for example determining the absolute quantity of the specific gas in the interior 2. Alternatively or additionally a change in the absolute quantity of the specific gas in the interior 2 over time can be determined. Alternatively or additionally a concentration of the specific gas in the interior 2 can also be determined.

In step 102 a hygiene program is automatically started and/or a notification is output to a user of the dishwasher 1 relating to the start of the hygiene program as a function of the determined quantity of the at least one specific gas in the interior 2. The automatic start of the hygiene program is preferably initiated by the control apparatus 12 of the dishwasher 1. To output the notification to the user the dishwasher 1 in particular comprises an output unit or output notifier 15 (see FIG. 5), which is designed to output the notification to the user. The output unit 15 in particular comprises a screen, a touchscreen and/or a speaker. The notification can be output visually and/or acoustically. The notification states for example: "Please start the hygiene program". To start the hygiene program, the dishwasher 1 can preferably comprise a prespecified start means, for example a specific button or a specific switching element or switch on a touchscreen. The start of the hygiene program can be triggered by the user of the dishwasher 1 for example also by way of a voice input.

The hygiene program comprises for example a cleaning segment, during which water or a water/detergent mixture is applied to the items being washed. Additionally or alternatively a hygiene tablet and/or hygiene powder can be dispensed during the hygiene program. Additionally or alternatively active oxygen can also be dispensed into the interior 2 of the dishwasher 1 during the hygiene program. Additionally or alternatively a salt can also be dispensed to the interior 2 during the hygiene program to bring about the hygiene function. Additionally or alternatively a wash liquor present in the interior 2 can also be cooled, in particular frozen, or warmed, in particular heated, during the hygiene program.

Figure 2:
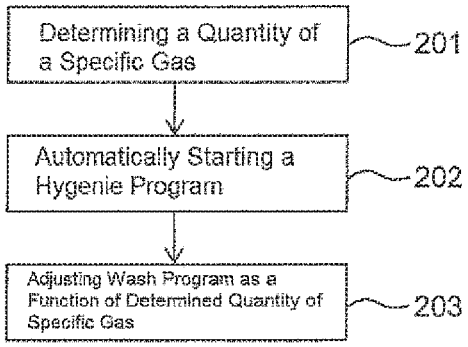
FIG. 2 shows a second exemplary embodiment of a method for operating a dishwasher.

FIG. 2 shows a second exemplary embodiment of a method for operating a dishwasher 1. The second exemplary embodiment in FIG. 2 comprises the steps 201, 202 and 203. Steps 201 and 202 correspond to steps 101 and 102 in FIG. 1 and are therefore not explained again here.

In step 203 the wash program is adjusted as a function of the determined quantity of the at least one specific gas, if the determined quantity is greater than a specific threshold value. This adjustment of the wash program is calculated and initiated in particular by the control apparatus 12 of the dishwasher 1.

Figure 3:
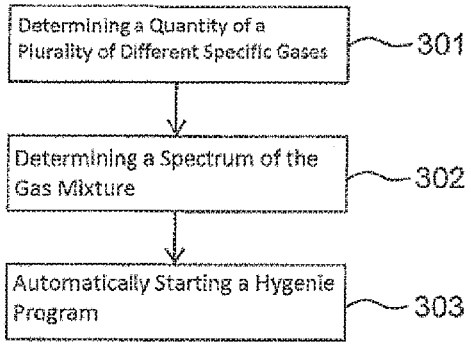
FIG. 3 shows a third exemplary embodiment of a method for operating a dishwasher.

FIG. 3 shows a third exemplary embodiment of a method for operating a dishwasher.

The third exemplary embodiment in FIG. 3 comprises the steps 301, 302 and 303:

In step 301 a respective quantity of a plurality of different specific gases in the interior 2 is determined by means of a plurality of different gas sensors 13 (see FIG. 6) during the wash program.

In step 302 a spectrum of the gas mixture present in the interior 2 is determined by means of the determined quantity of the plurality of different specific gases.

In step 303 the hygiene program is automatically started and/or the notification is output to the user relating to the start of the hygiene program as a function of the determined spectrum.

VOC sensors in particular are used as the gas sensors 13. The spectrum is determined in particular by means of pattern recognition using a neural network and a reference database. The reference database stores the prespecified reference patterns of spectra.

Figure 4:
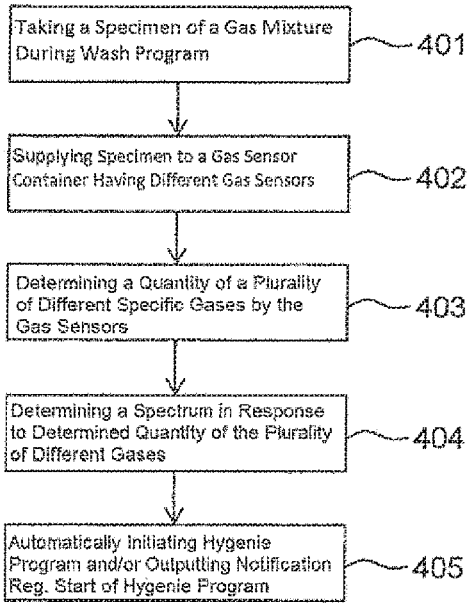
FIG. 4 shows a fourth exemplary embodiment of a method for operating a dishwasher.

FIG. 4 shows a fourth exemplary embodiment of a method for operating a dishwasher 1.

The fourth exemplary embodiment in FIG. 4 comprises the steps 401 to 405:

In step 401 a specimen of a gas mixture 17 present in the interior 2 of the dishwasher 1 during the wash program is taken (see FIG. 6). The specimen of the gas mixture 17 present in the interior 2 is taken during the wash program using warm air 16. The warm air 16 is generated in particular by means of a heater and supplied to the interior 2 by means of a fan or blower.

In step 402 the specimen of the gas mixture 17 taken is supplied to a gas sensor container 19 holding a plurality of different gas sensors 13 (see FIG. 6).

In step 403 a respective quantity of a plurality of different specific gases is determined by means of the gas sensors 13 in the gas sensor container 19 during the wash program.

In step 404 a spectrum is determined by means of the determined quantity of the plurality of different gases. A spectrometer 21 for example is deployed for this purpose (see FIG. 6).

In step 405 the start of the hygiene program is automatically initiated and/or a notification is output to the user of the dishwasher 1 relating to the start of the hygiene program as a function of the determined spectrum. The user can then initiate the start of the hygiene program him/herself.

FIG. 5 shows a perspective view of an embodiment of a dishwasher 1. The dishwasher 1 is in particular a domestic dishwasher. The dishwasher 1 has the interior 2, in particular the wash container 2', for holding items to be washed. The dishwasher 1 also has a carcass enclosing the wash container 2' and a door 3. The wash container 2' and the door 3 form a wash chamber 4 for washing items to be washed. The door 3 is shown in its opened position in FIG. 1. The door 3 can be closed or opened by pivoting about a pivot axis S provided at a lower end of the door 3.

The wash container 2' is box-shaped for example and can comprise a base 5, a top 6 opposite the base 5, a rear wall 7 opposite the door 3 and two opposing side walls 8, 9. The side walls 8, 9 in particular can be made of stainless steel sheet.

The dishwasher 1 also has at least one loading level 10. The at least one loading level 10 is preferably a holder for items to be washed in the dishwasher 1. A number of loading levels 10 in particular can be provided, comprising a lower rack, an upper rack and/or a flatware drawer. The several loading levels 10 are preferably arranged one above the other in the wash container 2'. Each loading level 10 can be moved as required into the wash container 2' in an insertion direction E or out of it in a pull-out direction A. To this end a rail 11 is preferably provided on both sides of a respective loading level 10.

A control apparatus 12 optionally provided in the carcass or door 3 of the dishwasher 1 is designed to control the sequence of wash programs for washing items being washed.

The dishwasher 1 also comprises at least one gas sensor 13, a start unit 14 and the output unit or output notifier 15. The start unit 14 and output unit 15 are integrated in particular in the control apparatus 12. The gas sensor 13 is designed to determine a quantity of at least one specific gas in the interior 2 during the wash program. The start unit 14 is designed to start a hygiene program as a function of the determined quantity of the at least one specific gas. The output unit 15 is designed to output a notification to a user of the dishwasher relating to the start of the hygiene program as a function of the determined quantity of the at least one specific gas. In particular the dishwasher 1 comprises a plurality of different gas sensors 13 (see FIG. 6) for determining a plurality of different specific gases in the interior 2.

FIG. 6 shows a schematic block diagram of a further embodiment of a dishwasher 1.

The reference character 16 in FIG. 6 designates warm air, which is used to take a specimen of a gas mixture 17 from the interior 2 during the wash program. The warm air 16 is generated for example by means of a heater and supplied to the wash container 2' by means of a blower. The specimen of the gas mixture 17 is supplied to a concentration container 18 by means of the warm air 16. The gas mixture 17 present in the concentration container 18 is then supplied to a gas sensor container 19, which holds a plurality of different gas sensors 13. In the example in FIG. 6 the gas sensor container 19 comprises nine different gas sensors 13, which are arranged in a matrix. The different gas sensors 13 analyze the complex mixture of molecules in the gas mixture 17. The different gas sensors 13 output signals 20 or a signal pattern describing the molecular composition of the gas mixture 17. These signals 20 are supplied to a computation unit 21', which in particular also comprises the spectrometer 21. The computation unit 21' determines a spectrum 23 of the gas mixture 17 from the signals 20. To this end the computation unit 21' can use reference patterns, which are stored in a reference database 22. The computation unit 21' can determine the spectrum by means of pattern recognition using a neural network and the reference database 22.

The determined spectrum 23 is supplied to the control apparatus 12 of the dishwasher 1. The control apparatus 12 can start the hygiene program automatically or initiate the outputting of a notification to the user of the dishwasher 1 as a function of the determined spectrum 23. The control apparatus 12 can also adjust the wash program as a function of the spectrum 23. This adjustment is shown as a feedback path with the reference character 24 in FIG. 6.

Although the present invention has been described based on exemplary embodiments, multiple modifications are possible.

REFERENCE CHARACTERS USED

1 Dishwasher
2 Interior
2' Wash container
3 Door
4 Wash chamber
5 Base
6 Top
7 Rear wall
8, 9 Side walls
10 Loading level
11 Rail
12 Control apparatus
13 Gas sensor
14 Start unit
15 Output unit
16 Warm air
17 Gas mixture
18 Concentration container
19 Gas sensor container
20 Signals, signal pattern
21 Spectrometer
21' Computation unit
22 Reference database
23 Spectrum
24 Adjusted wash program

The invention claimed is:

1. A dishwasher, comprising:

a controller configured to execute a wash program to wash items to be washed in an interior of the dishwasher, the wash program comprising at least one of a pre-rinse, a cleaning cycle, an intermediate rinse, or a final rinse;

a dispenser for dispensing a hygiene material in the interior of the dishwasher;

at least one gas sensor configured to determine a quantity of a specific gas in the interior during a performance of the wash program;

wherein the controller is configured to automatically start a hygiene program as a function of the determined quantity of the specific gas and during the performance of the wash program, such that the hygiene program and the wash program are performed at the same time; and an output notifier for outputting a notification to a user of the dishwasher relating to a start of the hygiene program as a function of the determined quantity of the specific gas and during the performance of the wash program, wherein the hygiene program comprises at least one of: 1) a hygiene tablet or hygiene powder is dispensed by the dispenser in the interior of the dishwasher, 2) an active oxygen is dispensed by the dispenser into the interior of the dishwasher, or 3) a salt is dispensed by the dispenser to the interior of the dishwasher.

2. The dishwasher of claim 1, constructed in the form of a domestic dishwasher.

3. The dishwasher of claim 1, wherein the at least one gas sensor comprises a plurality of different gas sensors for determining quantities of a plurality of different specific gases in the interior.

4. The dishwasher of claim 3, further comprising a spectrometer configured to determine a spectrum in response to the determined quantities of the plurality of different specific gases.

5. The dishwasher of claim 1, wherein the output notifier is integrated as a unit in the controller.

* * * * *